US006439861B1

(12) United States Patent
Shieh

(10) Patent No.: US 6,439,861 B1
(45) Date of Patent: Aug. 27, 2002

(54) BLOWER MACHINE WITH AN INHERENT AIR FLOW HEAT DISSIPATION STRUCTURE

(76) Inventor: Sen-Yuan Shieh, No. 42, San-Her Road, San-Chong City, Taipei Hsien (TW)

( * ) Notice: Subject to any disclaimer, the term of this patent is extended or adjusted under 35 U.S.C. 154(b) by 0 days.

(21) Appl. No.: 09/717,080

(22) Filed: Nov. 22, 2000

(51) Int. Cl.[7] ..... F04B 17/00
(52) U.S. Cl. ..... 417/371
(58) Field of Search ..... 417/371, 366, 417/357; 62/505

(56) References Cited

U.S. PATENT DOCUMENTS 4,518,325 A * 5/1985 Kingston ..... 417/368
4,762,472 A * 8/1988 King ..... 417/366
5,060,720 A * 10/1991 Wollaber et al. ..... 165/122
5,168,722 A * 12/1992 Brock ..... 261/DIG. 4
5,208,940 A * 5/1993 London et al. ..... 15/329
5,311,090 A * 5/1994 Ferlatte ..... 310/88
5,375,651 A * 12/1994 Colwell ..... 110/162
5,560,075 A * 10/1996 Jankowski ..... 15/327.2
5,727,330 A * 3/1998 Cucchi et al. ..... 34/666
5,814,908 A * 9/1998 Muszynski ..... 310/58
5,890,418 A * 4/1999 Song ..... 34/233
6,105,206 A * 8/2000 Tokumaru et al. ..... 15/344

* cited by examiner

*Primary Examiner*—Henry Bennett
*Assistant Examiner*—Daniel Robinson
(74) *Attorney, Agent, or Firm*—Troxell Law Office PLLC

(57) ABSTRACT

A blower machine having a motor on the internal section of a motor mount that drives rotation blades into rotary motion. There is a turning wheel consisting of two conjoined discs, with the rotation blades centrally anchored between the discs and an air output opening situated in the rotational direction of the rotation blades to provide for gaseous discharge. An air intake opening of the lower blower machine is located at the bottom end of the motor mount. When the rotation blades revolve, an air flow is induced from the exterior through the air intake opening and forms a flow channel of cold air that continuously cools the motor.

1 Claim, 4 Drawing Sheets

BLOWER MACHINE WITH AN INHERENT AIR FLOW HEAT DISSIPATION STRUCTURE

BACKGROUND OF THE INVENTION

1) Field of the Invention

The invention herein relates to a blower machine with an inherent air flow heat dissipation structure comprised of a motor on the internal section of a motor mount that drives rotation blades into rotary motion, the innovative features of which include the disposing of the air intake opening of the said blower machine at the bottom end of the motor mount such that when the rotation blades revolve, an air flow is induced from the exterior through the air intake opening which after coursing pass the bottom end of the motor emerges through the air output opening at the top end of the motor, thereby forming a flow channel of cold air that in advance continuously cools the motor and, as such, the blower machine with an inherent air flow heat dissipation structure of the present invention achieves excellent heat dissipation efficiency and the prolongation of service life.

2) Description of the Prior Art

Conventional blower machines, as indicated in FIG. 1, are typically comprised of a motor mount 3 of an internally installed motor 11 and a turning wheel 4, wherein the said turning wheel 4 consists of two discs 41 conjoined together and, furthermore, rotation blades 22 are anchored centrally in between the discs 41; an air output opening 43 is situated in the rotational direction of the blades 22 to provide for gaseous discharge and, furthermore, an air intake opening 44 is situated in the center of the top surface of the turning wheel 4; as such, the motor 11 on the internal section of the motor mount 1 drive the rotation blades 22 into rotary motion to induce an air flow from the exterior through the air intake opening 44 in the center of the turning wheel 4 and then discharge it from the air output opening 43 to thereby achieve a gaseous compression effect; however, due to the structural characteristics of the said blower machine, actual utilization does not meet expected ideals, with the overall shortcomings summarized below.

In the conventional blower machine, since the air output opening and air intake opening are both situated at one side of the motor, the air flow following induction into the air intake opening and discharge from the air output opening does not proceed pass the motor such that heat is generated after the motor is utilized for a certain period of time and when this heating occurs, due to an absence of a suitable channel capable of heat dissipation, the motor becomes hotter the longer it is utilized, resulting in the shortening of motor service life due to overheating.

SUMMARY OF THE INVENTION

The primary objective of the invention herein is to provide a blower machine with an inherent air flow heat dissipation structure capable of prolonging motor service life comprised of a motor on the internal section of a motor mount that drives rotation blades into rotary motion, wherein the air intake opening of said blower machine is disposed at the bottom end of the motor mount such that when the rotation blades revolve, an air flow is induced from the exterior through the air intake opening which after coursing pass the bottom end of the motor emerges through the air output opening at the top end of the motor, thereby forming a flow channel of cold air that in advance continuously cools the motor and, furthermore, the said flow channel of cold air inherently possesses motor air cooling heat dissipation efficacy and, as such, the blower machine with an inherent air flow heat dissipation structure of the present invention achieves excellent heat dissipation efficiency and the prolongation of service life, The structure, innovative features, function, and practical objectives of the present invention are further elaborated by the brief description of the drawings below and followed by the detailed description of the invention herein.

DETAILED DESCRIPTION OF THE INTENTION

Figure 1:
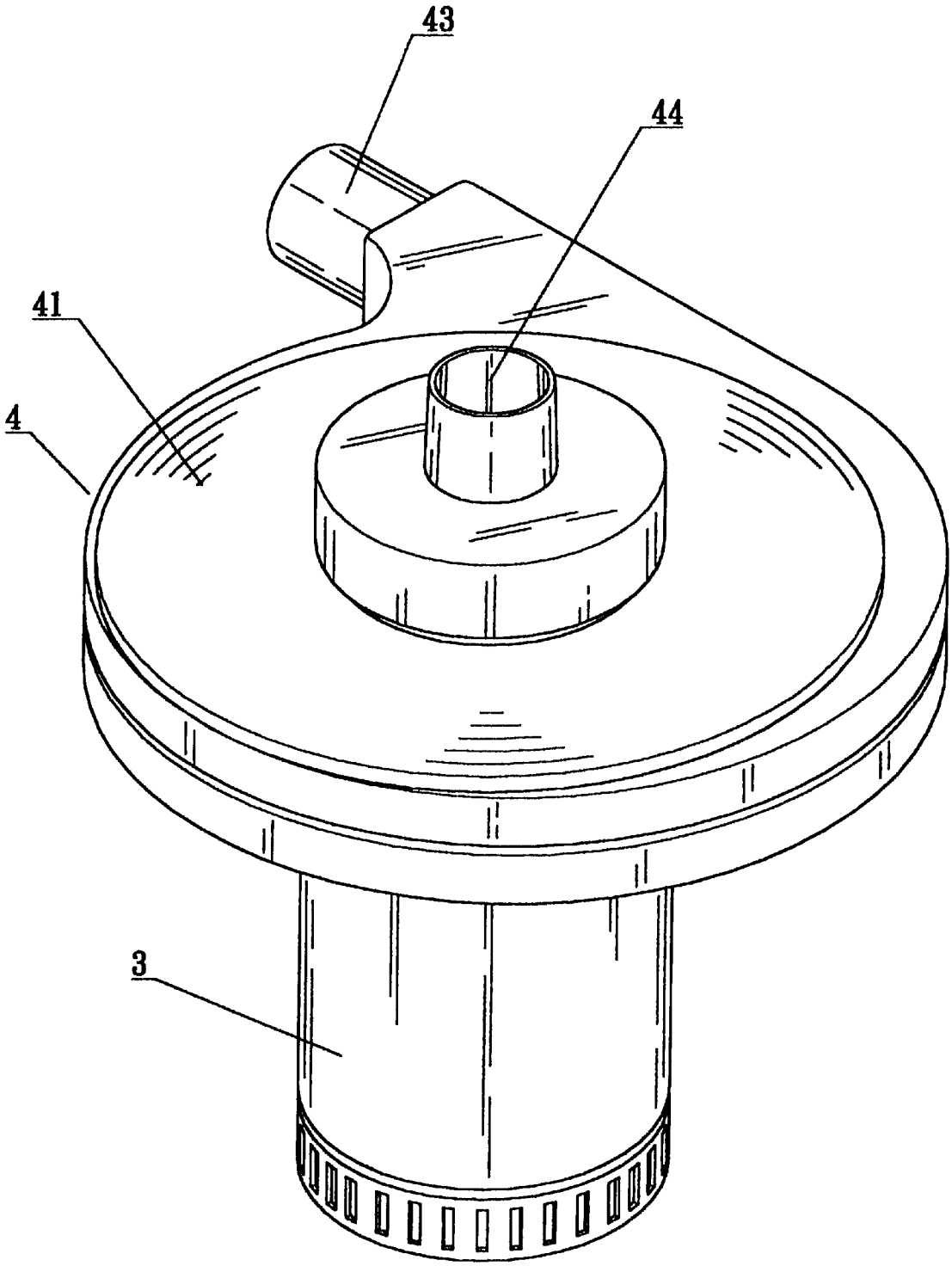
FIG. 1 PRIOR ART
FIG. 1 is an isometric drawing of a conventional blower machine.
Figure 2:
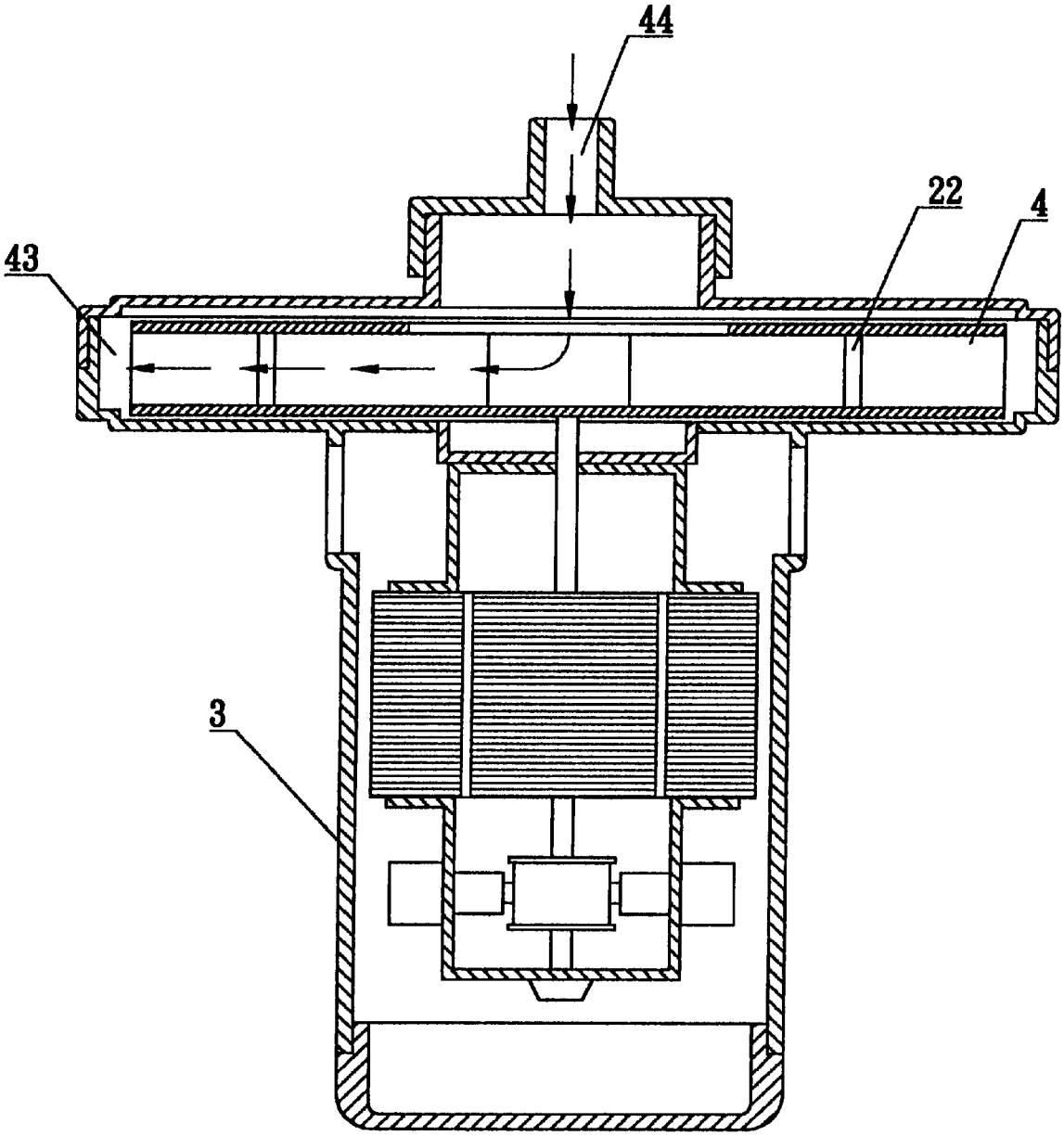
FIG. 2 PRIOR ART
FIG. 2 is a cross-sectional drawing of the conventional blower machine.
Figure 3:
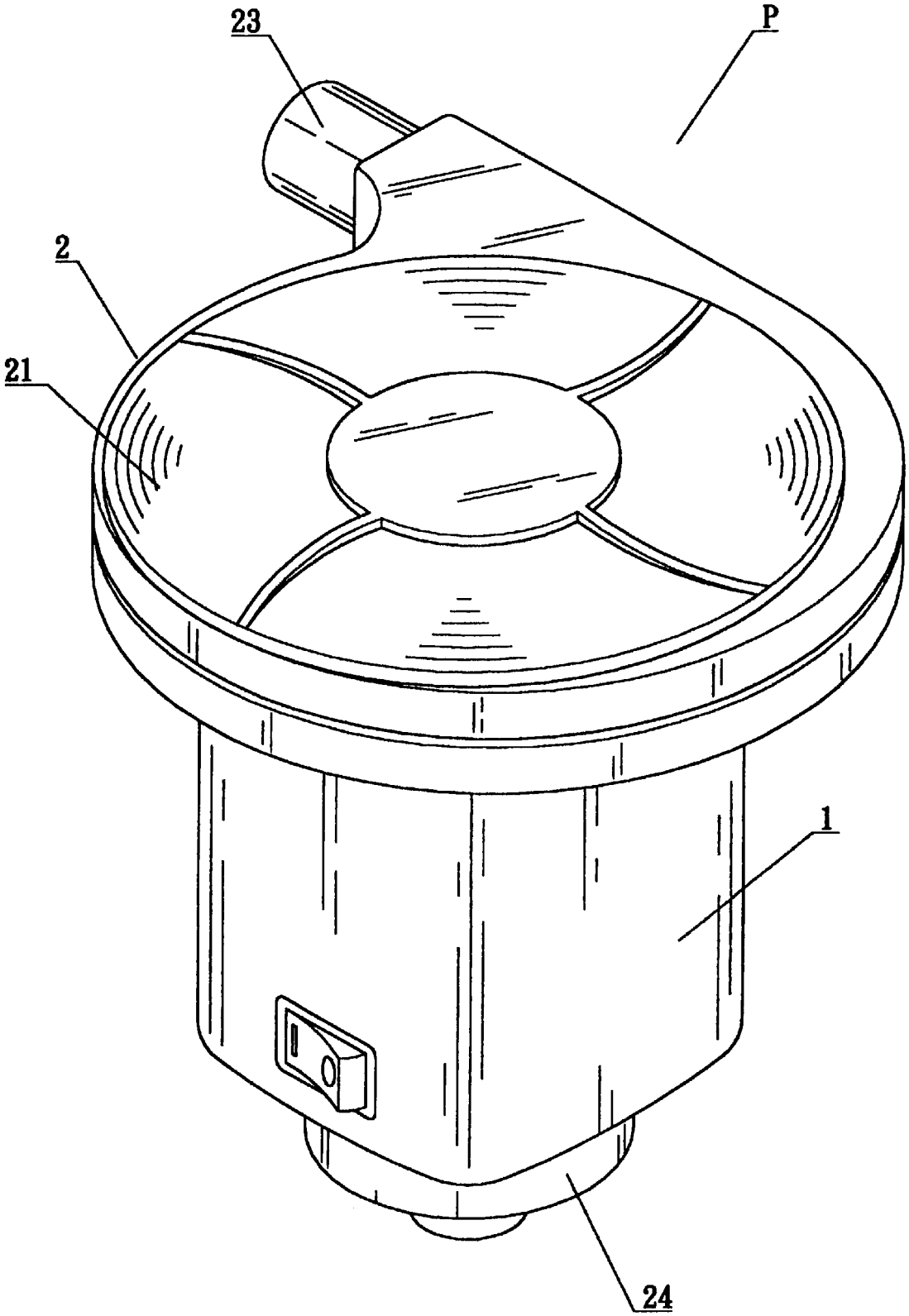
FIG. 3 is an isometric drawing of the blower machine of the invention herein.
Figure 4:
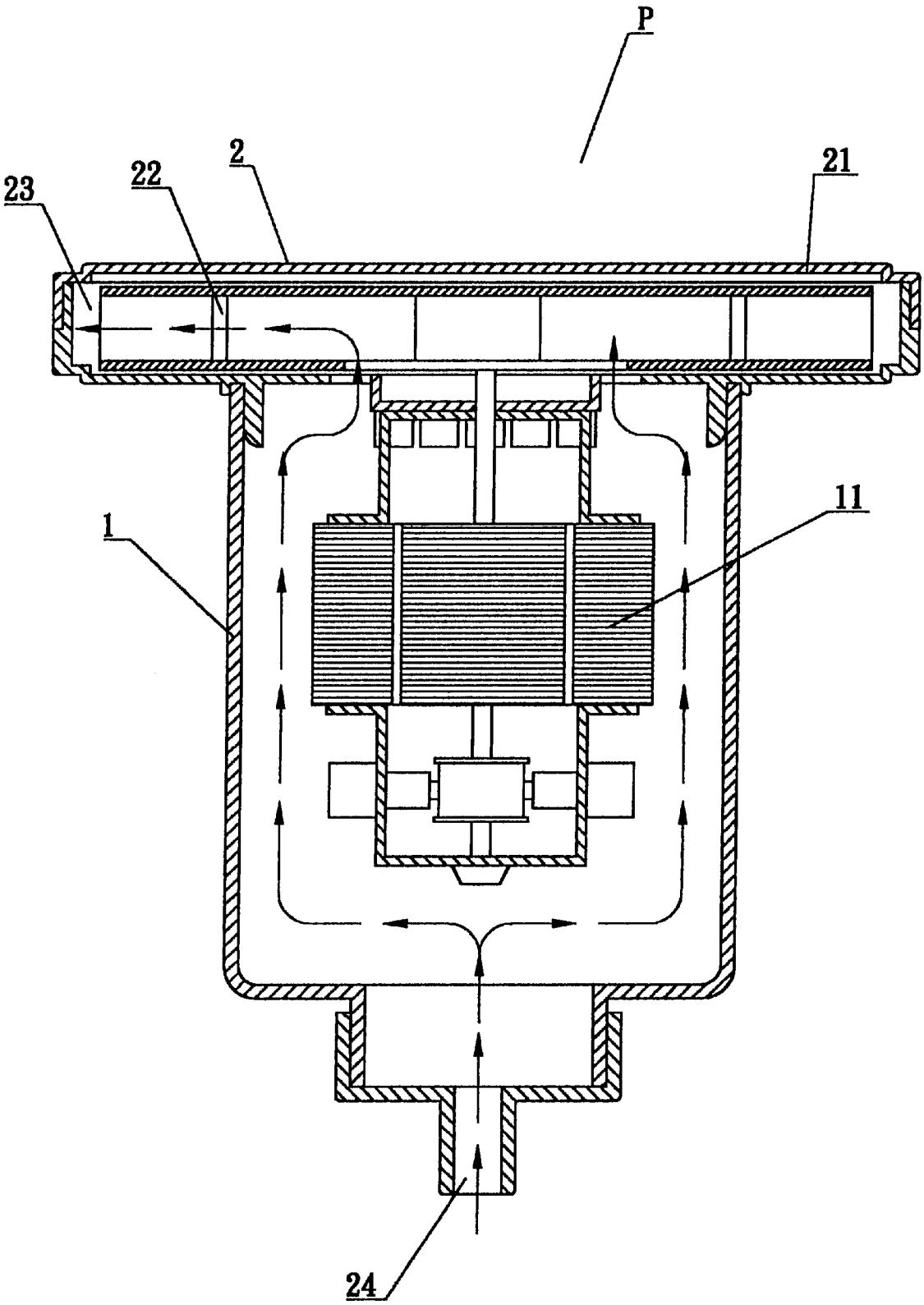
FIG. 4 is a cross-sectional drawing of the blower machine of the invention herein.

Referring to FIG. 3 and FIG. 4, through which the structural arrangement of the invention herein can be clearly understood, the said blower machine P is comprised of a motor mount 1 of an internally installed motor 11 and a turning wheel 2, wherein the said turning wheel 2 consists of two discs 21 conjoined together and, furthermore, rotation blades 22 are centrally anchored in between the discs 21; an air output opening 23 is situated in the rotational direction of the blades 22 to provide for gaseous discharge; and the innovative features of the present invention include the disposing of the said blower machine P air intake opening 24 at the bottom end of the motor mount 1.

Referring to FIG. 4, when the motor 11 on the internal section of the motor mount 1 drive the rotation blades 22 into rotary motion, an air flow is inducted through the air intake opening 24 at external bottom end of the motor mount 1 which after coursing pass the bottom end of the motor 11 emerges through the air output opening 23 at the top end of the motor 11, thereby forming a flow channel of cold air that in advance continuously cools the motor 11 and, furthermore, the said flow channel of cold air inherently possesses motor 11 air cooling heat dissipation efficacy; as such, since the motor is continuously cooled by the cold air, it is not subjected to high heat conditions such that the service life of the motor 11 is prolonged and, furthermore, the excellent heat dissipation efficiency thereby obtained is capable of extending the service life of the blower machine with built-in air flow heat dissipation structure of the present invention.

What is claimed is:

1. A blower machine comprising:

a) a motor having a rotatable output shaft extending from a first end thereof;

b) a turning wheel mounted on the output shaft on the first end of the motor so as to rotate with the output shaft, the turning wheel including two discs with a plurality of blades therebetween, and, c) a housing enclosing the motor and the turning wheel, the housing having a turning wheel air output opening located on the first end of the motor adjacent to a periphery of the turning wheel and a turning wheel air intake opening located on a second end of the motor opposite to the first end of the motor whereby rotation of the turning wheel draws air into the housing through the air intake opening such that air passes over the motor before entering the turning wheel, thereby cooling the motor.

* * * * *